United States Patent [19]

Egosi

[11] 4,041,855

[45] Aug. 16, 1977

[54] OPPOSED BOX BALING PRESS

[75] Inventor: Isaac Egosi, Kiryat Mozkin, Israel

[73] Assignee: Effic Trading and Services Ltd., Zurich, Switzerland

[21] Appl. No.: 711,338

[22] Filed: Aug. 4, 1976

Related U.S. Application Data

[63] Continuation-in-part of Ser. No. 603,380, Aug. 11, 1975, Pat. No. 4,006,679.

[51] Int. Cl.[2] ..... B30B 7/00

[52] U.S. Cl. ..... 100/138; 100/215; 100/218; 100/249

[58] Field of Search ..... 100/137, 138, 215, 218, 100/220, 249, 295, 245, 221, 274; 53/124 R, 124 B; 141/73

[56] References Cited

U.S. PATENT DOCUMENTS

| | | | |
|---|---|---|---|
| 1,372,898 | 3/1921 | Nelson | 100/218 |
| 1,857,707 | 5/1932 | Bell | 100/249 X |
| 2,358,765 | 9/1944 | Stadlin | 100/218 UX |
| 2,780,989 | 2/1957 | Guy | 100/218 |
| 3,583,312 | 6/1971 | Van Doren | 100/215 X |
| 3,908,539 | 9/1975 | O'Brien | 100/218 |

FOREIGN PATENT DOCUMENTS

| | | | |
|---|---|---|---|
| 569,026 | 5/1945 | United Kingdom | 100/215 |

*Primary Examiner*—Billy J. Wilhite
*Attorney, Agent, or Firm*—Watson, Cole, Grindle & Watson

[57] ABSTRACT

A baling press has opposed boxes with a press mechanism movable along the lint feed box for pre-packing fibrous material fed continuously thereto. A slotted gate is shiftable into and out of the path of the press mechanism which includes leg members movable for transferring the material from the upper one of the boxes to the lower one thereof. The gate may be closed while the leg members extend into the lower box during transfer of the material, so that the material is restrained by the leg members which may be also moved out of the lower box while the gate is closed.

6 Claims, 13 Drawing Figures

OPPOSED BOX BALING PRESS

RELATED APPLICATION

This application is a Continuation-In-Part of U.S. application Ser. No. 603,380, filed Aug. 11, 1975 now U.S. Pat. No. 4,006,679.

BACKGROUND OF THE INVENTION

This invention relates generally to a press for baling fibrous material, and more particularly to such a press having opposed boxes and a reciprocable pre-packing mechanism extendable through a slotted gate or fork assembly used in lieu of dog elements for preventing the compressed fibers in the lower box from swelling upwardly.

Fibrous material to be pressed and baled is usually fed in a loose or a bat form into a lint slide and/or a hopper from which it is fed through a side wall into a lint box located between a reciprocating tamper and the press box.

In such an arrangement the lint box is charged from the side at intervals and is further charged downwardly into the press box by means of the tamper which has a substantially constant-length stroke.

Existing presses are either of the single or multi-box types, usually double boxes, wherein the boxes are arranged side-by-side for rotation about a center post. The tamper, normally comprising a piston operated tamper plate, is disposed over one of the boxes while the compression means, normally a hydraulic ram, is disposed over or under the other box so as to permit tamping of the fibrous material into one box and the pressing of the material into bales in the other box. When the fibrous material already tamped is to be fully compressed, the boxes are rotated through 180° so as to dispose the filled box in line with the hydraulic ram, while the empty box from which a compacted bale has been removed, is now disposed beneath the tamper for filling and tamping of newly fed fibrous material. The boxes are again rotated through 180° for disposing the tamped fibrous material in line with the hydraulic ram for compressing same as aforedescribed.

The difficulty with the side charging of fibrous material into the lint box is that the tamper must be in a fully retracted or upward position above the inlet opening for tamping a batch of material. And, because the tampers are charging the material with a substantially constant-length stroke, the material near the bottom of the lint box is obviously of lesser density than the tamped material near the upper portion of the lint box. Such an arrangement is therefore inefficient, since the tamper must be fully elevated for tamping each batch thereby increasing the time for the tamping cycle. Moreover, since uniform density throughout the height of the tamped batch is not readily controllable, the lint or upper box must normally be of a larger contruction. The rotatable side-by-side box feature is likewise inefficient and cumbersome because of the space and the equipment required for such a press.

Moreover, the presently designed presses either use some type of door arrangement for exposing the compacted bale for removal, or a specially designed cylinder bears against an opposite side of the press box for causing the fibrous material to be compressed between the bottom ram and a top cylinder which closes the press box. The fibrous material is then extruded out of the press box to form a compact bale while the ram is moved upwardly and the top cylinder is retracted.

And, in those opposed box baling presses having a shiftable gate between boxes, dog elements or some other retention means is required for preventing the slightly compressed fibers transferred into the lower box from bulging or swelling upwardly before the gate is closed in readiness for the lower compression ram.

SUMMARY OF THE INVENTION

It is therefore an object of the present invention to provide a baling press which avoids the difficulties of the prior art presses by an arrangement which is highly efficient and effective yet less cumbersome and more economical to manufacture and operate.

Another object of this invention is to provide such a baling press wherein the upper and lower boxes are opposed axially and are separated by a shiftable slotted gate permitting pre-packed fibrous material to be transferred into a compression chamber of the lower box section upon being shifted away from the boxes, the slotted gate being re-shifted to overlie the pre-packed fibers without interfering with the transfer mechanism which maintains pressure on the fibers, thereby avoiding the need for dog elements or other retention means.

Another object of the invention is to provide such a baling press wherein a packer unit is mounted on the upper box for axial movement therealong in short reciprocating strokes while moving from a discharge end toward an open end of the upper box for increasing the baling capacity of the press as continuously fed fibrous material is incrementally tamped in a continuous manner.

A still further object of the present invention is to provide such a baling press wherein the compressed bale is quickly and effectively exposed for removal without the need for doors or an extrusion arrangement.

In carrying out these objectives the baling press in accordance with the invention comprises an upper box or receptacle into which fibrous material is continuously fed and continuously pre-packed with the slotted gate closed in a manner whereby the density of the pre-packed material is substantially uniform throughout. The packing unit on this receptacle includes leg members projecting into and out of the receptacle at opposite sides thereof and, upon sensing a predetermined volume of pre-packed material, the leg members transfer such material through the open gate into a compression chamber of the opposed lower box. A continuous conveyor belt may be provided for regulating the amount of material to be fed into the upper box through rollers forming an effective seal between the upper box and the atmosphere. Air manifolds may be provided below such rollers for evenly distributing the fibrous material from side to side within the upper box. The slotted gate is shifted out of the path of the leg members when transferring the pre-packed material into the lower box and, while the leg members maintain pressure on the pre-packed fibers, the gate is shifted inwardly with the leg members disposed within the slots. The leg members may then be raised for another pre-packing operation while a lower ram finally compresses the pre-packed fibers against the gate. The compression chamber may then be shiftable away from the gate and the discharge opening of the upper box so as to expose the compressed bales for removal.

Other objects, advantages and novel features of the invention will become more apparent from the following detailed description of the invention when taken in conjunction with the accompanying drawings.

DESCRIPTION OF THE PREFERRED EMBODIMENT

Figure 1:
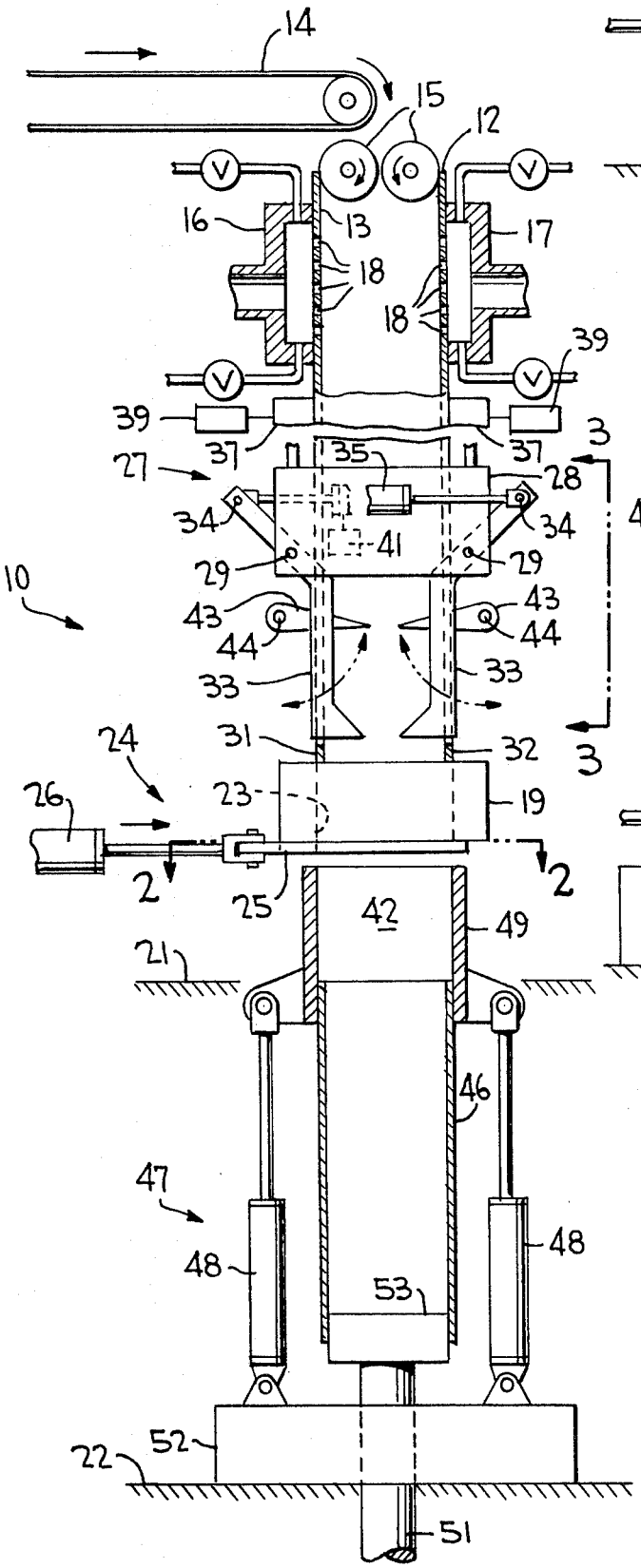
FIG. 1 is a side elevational view partly in section showing the general arrangement of the baling press in accordance with the invention.

Turning now to the drawings wherein like reference characters refer to like and corresponding parts throughout the several views, the baling press generally designated 10 in FIG. 1 includes an elongated upper box or hollow receptacle 11 for the reception of fibrous material to be baled through an open end 12 thereof. Such fibrous material referred to herein is intended to include cotton, wool, man-made fibers and the like which are usually available for the textile industry. Depending on the requirements for a given baling operation, receptacle 11 may be provided with a lint box section 13 as an integral extension thereof shown in FIG. 1, or mounted thereto in some suitable manner.

Conveyor means is provided upstream of the lint box for continuously feeding fibrous material therein. Such conveyor means may comprise an endless conveyor belt 14 driven at a variable speed by some suitable means to vary the accumulation of fibrous material on the belt when desired, thereby in effect serving as a surge regulator or an operational storage for the fibrous material. It should be understood that this variable and controlled speed conveyor is not for the purpose of feeding a batch of fibrous material into the lint box section but for compensating for press operation (especially if intermittent reception of the material is carried out) and for the continuously fed feature of this particular baling press. For example, by decreasing the speed of belt 14 a thicker layer of fibrous material will be formed thereon, and by speeding up the belt the fibrous layer will become thinner. And, if desired, liquid may be sprayed over the fibrous material lying on belt 14 to increase the humidification thereof.

Rollers 15 may be disposed near the open end 12 of the lint box section for rotating about fixed axes, as shown, so as to effectively seal off open end 12 while at the same time permitting the fibrous material to be fed into the lint box section. These rollers serve an additional purpose of pre-packing the incoming fibrous material at its point of entry into upper box 11.

The lint box section may also be provided with opposing air manifolds 16 and 17 connected to suitable air supplies and controlled by means of the valving as shown schematically. The manifolds are disposed on opposite sides of the lint box section of receptacle 11 so as to communicate with the interior thereof through openings 18. Water vapors may be introduced into the air supplies for blowing moist-laden air into the lint box section from one of the manifolds and exiting through the opposite manifold, and vice-versa, by appropriately controlling the valving for the two manifolds. Therefore, the incoming fibrous material may be humidified in a positive manner at the particular times desired. Moreover, manifolds 16 and 17 serve to evenly distribute the incoming fibrous material between opposite sides of the receptacle 11 as air blown from one manifold exits through the other, or as air is sucked from one manifold to effect a layering of the fibrous material in the upper box. Rollers 15 therefore effectively serve to seal the lint box section from the atmosphere thus retaining a good moisture restoration of the incoming fibrous material.

The upper box or receptacle 11 is made integral with or otherwise fixedly connected to an upper sill 19 by means of which the upper box is supported in any customary manner on an upper support surface 21 or on a lower support surface 22. The upper box has a discharge opening 23 which is opened and closed by a gate means 24 comprising slotted gate plate or fork member 25 fully covering the discharge opening, and actuated in the direction of the reverse arrows shown in FIG. 1 by means of a hydraulic cylinder 26. The slotted gate and its operation will be more fully described hereinafter.

A packer unit generally designated 27 is provided for continuously pre-packing the fibrous material which is being continuously fed into receptaclle 11. This packer unit generally comprises a pair of opposing side plates 28 interconnected by means of rods 29 located outwardly of the side walls 31 and 32 of receptacle 11 (see also FIG. 5). A plurality of leg members 33, fewer or more than the number shown in the drawings, are mounted for pivotal movement on rods 29 at opposite sides of the upper box, the leg members also being mounted at their upper free ends for pivotal movement on rods 34. These rods 34 are interconnected by means of hydraulic cylinders 35 located outwardly and adjacent side plates 28. Also, spaced vertical openings 36 are provided in side walls 31 and 32 and extend between sill 19 and lint box section 13. The leg members are disposed respectively within these openings so as to project inwardly and outwardly of receptacle 11 upon extension and retraction of the pistons of cylinders 35, respectively. It can be seen that, as the piston rods of these cylinders are extended, rods 34 are moved away from one another so that the lower portions or feet of the leg members project inwardly of the upper box as the leg members pivot on rods 29. The converse is true for projecting the feet of the leg members outwardly of the upper box through slots 36 as the piston rods of cylinders 35 are retracted.

The packer unit is disposed for axial movement along receptacle 11 between sill 19 and the lint box by means of hydraulic cylinders 37 interconnecting side plates 28 with some portion of the upper box. Suitable control means provided for these cylinders 37 permit the pistons thereof to reciprocate in short strokes and to retract progressively as increased amounts of fibrous material are being pre-packed by the leg members. Accordingly, packet unit 27 is likewise reciprocated in short strokes and is moved progressively upwardly away from the discharge end of the upper box. During these reciprocating and translating movements of the packer unit, hydraulic cylinders 35 are so controlled as to cause the pistons thereof to retract and extend during reciprocation of the packer unit so as to cause the lower portions of the leg members to project inwardly while they are being moved downwardly and project outwardly while they are being moved upwardly.

Figures 2, 3, 4A, 4B, 4C, 4D, 4E, 4F, 5, 6:
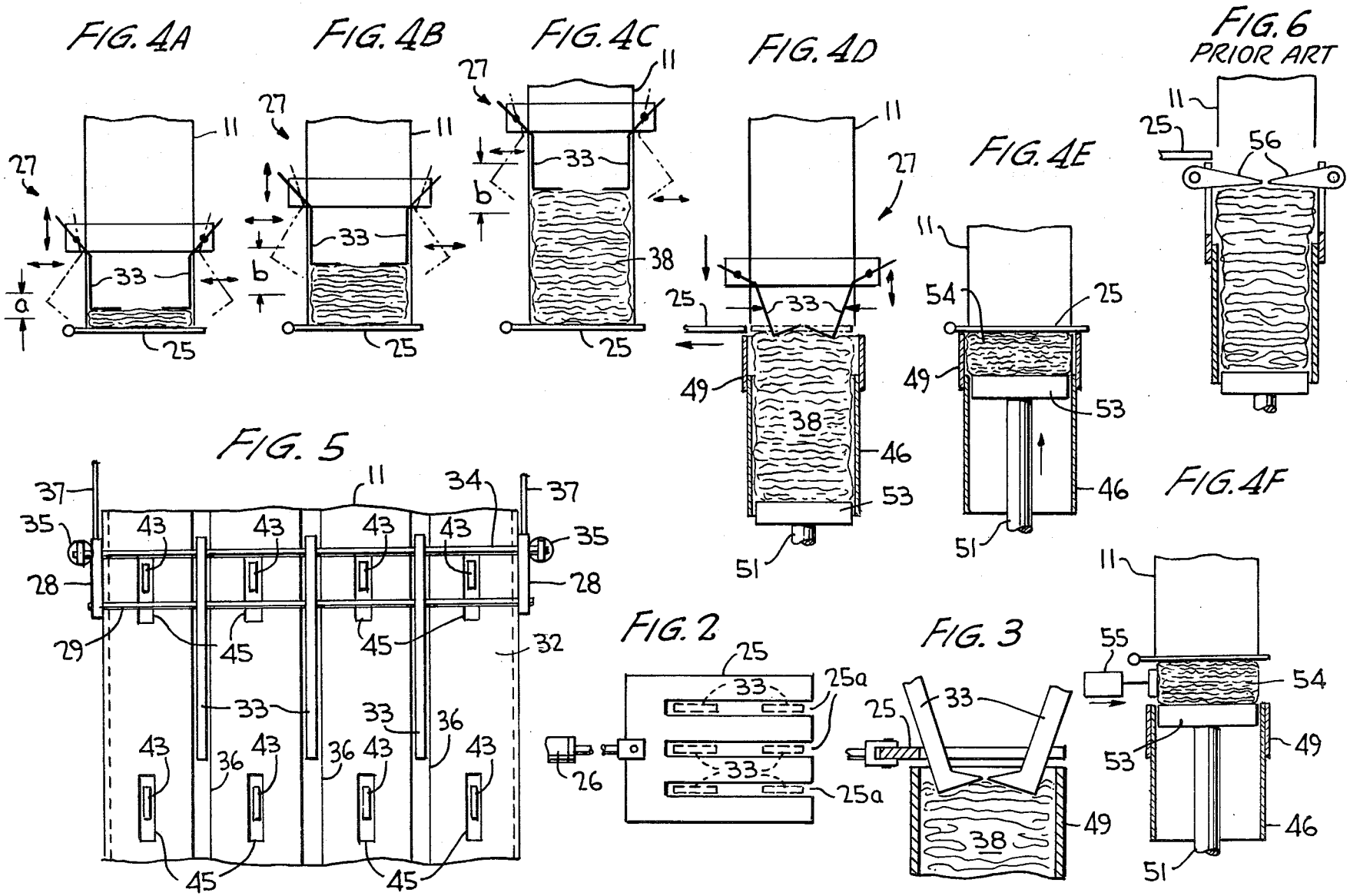
FIG. 6 PRIOR ART
FIG. 2 is a plan view of the slotted gate in accordance with the invention, taken along line 2—2 of FIG. 1.
FIG. 3 is a side elevational view, partly in section, of the closed gate in relation to the leg members and lower box during a stage of the baling operation.
FIGS. 4A through 4F are schematic views showing the various steps in carrying out the baling operation in accordance with the FIG. 1 apparatus.
FIG. 5 is a side elevational view of part of the upper box or receptacle taken along line 5—5 of FIG. 1.
FIG. 6 is a prior art view comparable to the FIG. 4D stage of operation using dog elements for retaining the pre-packed material in the lower box.

As shown in FIG. 2, gate or fork member 25 has slots 25*a* open at an end opposite the cylinder 26 end, and disposed in alignment with leg members 33 so that the leg members may extend therethrough, as shown in FIG. 3, during a stage of the baling operation.

Referring to FIGS. 4A through 4D, as a fresh quantity of fibrous material is being fed into receptacle 11, it is pre-packed by the leg members as they move inwardly, downwardly, outwardly, upwardly, inwardly and downwardly again in short vertical strokes *a* near the discharge opening as shown in FIG. 4A. While the fibrous material is being continuously fed the packer unit is moved progressively upwardly along receptacle 11 and continues its short strokes *a* after which the strokes may be increased to *b* as shown in FIG. 4B until a pre-packed bale 38 of a predetermined volume and density is formed as shown in FIG. 4C. Sensing devices 39 shown in FIG. 1 and connected to cylinders 37, and sensing devices 41 connected to cylinders 35, may be provided for sensing the volume and density of the fibrous material when it reaches a predetermined value as at 38. Suitable signals are therefore delivered to cylinders 37 and 35 for respectively effecting a downward movement of packer unit 27 and an inward movement of the leg members as shown in FIG. 4D. The pre-packed bale 38 is therefore transferred from receptacle 11 and into a compression chamber 42 (FIG. 1) through the open gate or fork member 25. As shown in FIG. 4D, the leg members are moved inwardly to their furthest extent so as to effectively block the passage of any fibrous material into the compression chamber which may have been accidentally fed into the upper box while bale 38 is being transferred out of the upper box.

Referring to FIGS. 1 and 5, it can be seen that dog elements 43 may be pivotally mounted on shafts 44 located outwardly of opposite side walls 31 and 32, the shafts being mounted on some portion of the press (not shown) for preventing the pre-packed fibrous material from sponging or expanding as leg members 33 project outwardly of the upper box during the reciprocating movement of the packer unit. These dog elements extend through suitable openings 45 provided in opposite side walls of the upper box and are designated for limited pivotal movement shown diagrammatically by the arcuate double arrows in FIG. 1.

An opposed lower box or receptacle 46 is in an axially opposed relationship to the upper box for the reception of prepacked bale 38 as in the manner shown in FIG. 4D. Compression means 47 is associated with this lower box, such means comprising hydraulic cylinders 48 connected to a sleeve member 49, and a hydraulic ram 51 actuated by some suitable means (not shown) located below support 22. Cylinders 48 are mounted on a bottom sill 52 of the press and the pistons of these cylinders are connected to sleeve 49. This sleeve member defines compression chamber 42 together with a ram plate for follow block 53 of the ram when moved upwardly within the lower box to compress the pre-packed bale within the sleeve member and against the closed gate plate 25. (See FIG. 4E). After the pre-packed fibrous material is compressed into a compact bale 54, the piston rods of cylinders 48 are retracted so as to lower sleeve member 49 and expose the compacted bale as in the manner shown in FIG. 4F. An ejection cylinder 55 may thereupon be actuated for pushing bales 54 from the surface of follow block 53.

In accordance with the invention, when pre-packed bale 38 is transferred by leg members 33 from receptacle 11 and into lower box 46 through open gate 25, the leg members are caused (such as by sensing devices 39) to be momentarily held in their position of FIGS. 3 and 4D just below the top edge of sleeve 49. Slotted gate 25 is then caused to be shifted inwardly to overlie sleeve 49 while leg members 33 are maintained in this position. Slots 25*a* of the gate are so disposed relative to the leg members so as to lie therewithin upon the inward shift of the gate, as shown in FIGS. 2 and 3. Interference between the gate and the leg members is therefore avoided. The leg members are then caused to be moved upwardly through slots 25*a*, without interference, in readiness for pre-packing another bale of fibrous material while the gate maintains its inwardly closed position of FIGS. 3 and 4E whereupon lower ram 51 is actuated for compressing the pre-packed bale against the closed gate 25.

With such an arrangement as aforedescribed, leg members 33 restrain the pre-packed fibrous material in the lower box against sponging or expanding outwardly of sleeve 49 before the gate is shifted into its closed position. Any need for dog elements 56, normally mounted on machines as in accordance with the prior art typically shown in FIG. 6, is therefore avoided. These dog elements, or a canvas cover supported over the top of the pre-packed bale as shown in British Pat. No. 569,026, are normally required to restrain the pre-packed bale from expanding upwardly. The need for such restraining means is therefore completely avoided by the invention wherein the leg members themselves serve as the restraining means while the slotted gate is shifted into its closed position.

Figure 7:
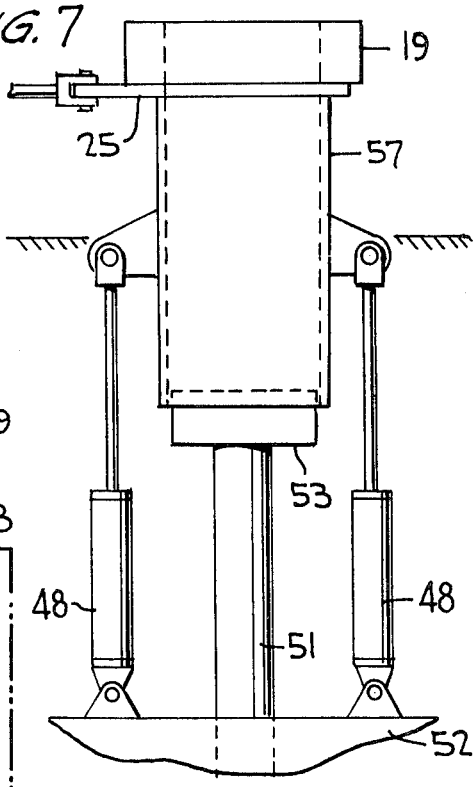
FIGS. 7 and 8 are views of another embodiment of a lower box including a compression mechanism in accordance with the invention.
Figure 8:
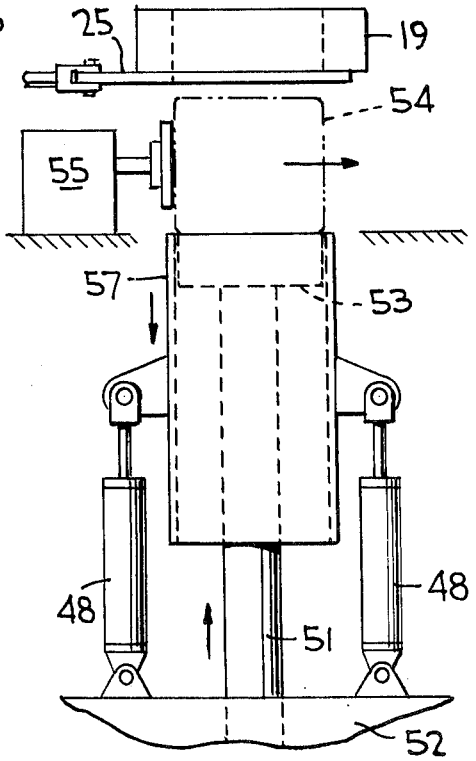

FIGS. 7 and 8 illustrate a modification of the FIG. 1 compression means wherein a receptacle 57 is instead connected to the pistons of cylinders 48. In the position of FIG. 7, the pre-packed bale 38 is transferred thereto through open gate plate 25, so that a portion of the interior of receptacle 57 serves as a compression chamber. The pre-packed bale is compressed into a compact bale 54 as hydraulic ram 51 is actuated to move upwardly within receptacle 57 to carry out the compacting operation as before. Thereafter, cylinders 48 are actuated to shift receptacle 57 away from gate plate 25 as in the manner shown in FIG. 8 so as to expose compact bale 54 for removal from ram plate 53 by means of ejection cylinder 55 similarly as aforedescribed.

To summarize the operation of the baling press according to the invention, the fibrous material to be baled is conveyed into the lint box section of the upper receptacle by means of conveyor 14 through rollers 15 which may be idler rollers or driven for rotation about fixed axes or movable axes if desired. The incoming fibrous material may be humidified by the air manifolds and at the same time folded and evenly distributed between opposite side walls of the upper box. While the fibrous material is being first fed into receptacle 11, leg members 33 of the packer unit are substantially in the position shown in FIG. 4A near gate plate 25. The packer unit thereupon reciprocates axially along receptacle 11 in short strokes while leg members 33 are moved to project inwardly and outwardly of opposite side walls of the upper box. While the fibrous material is being continuously fed into receptacle 11, the packer unit is progressively moved upwardly away from the gate plate while at the same time reciprocating so as to effect as dense and as compact a bale as desired therethroughout. The stroke length of the reciprocating packer unit may be adjusted and controlled for positioning when necessary. Upon reaching a pre-packed bale 38 of a predetermined volume and density, as sensed by sensing devices 39 and 41, suitable signals are delivered to cylinders 35 and 37 so as to cause the leg members to be moved inwardly and the packer unit to be moved downwardly as in the manner shown in FIG. 4D for transferring the pre-packed bale through open gate 25 and into lower receptacle 46. Expansion of the pre-packed bale is restrained in the lower box by the leg members which are maintained in their position in FIGS. 3 and 4D just below the top edge of sleeve 49. The slotted gate is then closed while the leg members are in such position, following which the leg members are raised and the bale is compressed against the closed gate as ram 51 is actuated. Sleeve member 49 is then shifted away from the slotted gate so as to expose the compact bale for removal from ram plate 53 by means of ejecting cylinder 55. Thereafter, sleeve 49 is shifted back into its position of FIG. 1 so that the entire cycle of operation may continue as in the manner aforedescribed.

As an alternative to sleeve 49, receptacle 57 may be provided so as to be shifted away from the slotted gate for exposing the compact bale before removal.

The arrangement according to the invention not only improves upon the efficient operation of the standard baling presses, but the bales may also be easily and conveniently wrapped by means of the commonly available straps and/or wrapping material simply by disposing same between the sleeve member and the gate plate and between the ram follow block and the lower receptacle. Completion of this wrapping and/or strapping operation may be subsequently carried out in any convenient manner. Moreover, since no doors are provided for exposing the compacted bales as normally required, the present baling apparatus may be of a lighter and more compact construction. The extrusion approach to compacting bales, as well as additional restraining means for the pre-packed bale in the lower box, are likewise avoided by the present arrangement.

Obviously, many modifications and variations of the present invention are made possible in the light of the above teachings. It is therefore to be understood that within the scope of the appended claims the invention may be practiced otherwise than as specifically described.

What is claimed is:

1. A baling press for forming bales of fibrous material, comprising:

a receptacle having infeed and discharge ends through which fibrous material is conveyed;

means for conveying fibrous material into said receptacle through said infeed end;

packing means including leg members axially movable along said receptacle for pre-packing fibrous material therein;

co-axial bale compression means including a compression chamber adjacent said discharge end of said receptacle;

a shiftable gate disposed between said discharge end and said compression chamber for opening and closing said discharge end, said leg members being movable toward said discharge end for transferring the fibrous material pre-packed in said receptacle through said discharge end into said compression chamber for compression into bales;

said gate being slotted so as to permit said gate to be closed over said discharge end while said leg members extend into said compression chamber during transfer of the pre-packed fibrous material thereinto, whereby said leg members serve to restrain the pre-packed fibrous material within said compression chamber, and whereby said leg members may be moved away from said discharge end while said gate is closed; and said compression means including means for shifting said chamber to expose the bale for removal away from said compression means.

2. The baling press according to claim 1, wherein at least a pair of said leg members are provided as lying in a common plane, said gate having at least one slot therein lying in said plane.

3. The baling press according to claim 1, wherein said packing means is axially reciprocable along said receptacle in short strokes and incrementally movable axially therealong between said ends while reciprocating for pre-packing the fibrous material in correspondingly equal amounts, said leg members being movable into and out of said receptacle from opposite sides thereof for pre-packing the fibrous material in incremental amounts.

4. A baling press arrangement for forming bales of fibrous material, comprising:

a receptacle having infeed and discharge ends through which fibrous material is conveyed;

a shiftable gate for opening and closing said discharge end;

means for conveying the fibrous material into said receptacle through said infeed end;

packing means axially reciprocable along said receptacle in short strokes and incrementally movable axially therealong from said discharge end toward said infeed end while reciprocating for pre-packing the fibrous material in corresponding incremental amounts while the material is being fed, said packing means including elements movable into and out of said receptacle from opposite sides thereof for pre-packing the material in incremental amounts corresponding to the incremental movement toward said infeed end thereby increasing the packed density of the fibrous material;

means for compressing the pre-packed material, including a compression chamber located adjacent said gate co-axially with said receptacle;

said elements of said packing means being movable toward said compression chamber for transferring the material from said receptacle thereinto for compression into a compact bale;

said gate being slotted for permitting said gate to be shifted into the path of said elements of said packing means and overlying said compression chamber while said elements extend into said compression chamber during transfer of the material, whereby the pre-packed material within said chamber is restrained by said elements which are capable of moving away from said chamber while said gate overlies said chamber.

5. The baling press according to claim 4, wherein said elements comprise leg members pivotally mounted for movement into and out of said receptacle.

6. The baling press according to claim 5, wherein at least a pair of said leg members are provided as lying in a common plane, said gate having at least one slot therein lying in said plane.

* * * * *